US008668100B2

(12) United States Patent
Castillo Higareda

(10) Patent No.: US 8,668,100 B2
(45) Date of Patent: Mar. 11, 2014

(54) BOTTLES WITH TOP LOADING RESISTANCE

(75) Inventor: Jose de Jesus Castillo Higareda, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 335 days.

(21) Appl. No.: 12/828,156

(22) Filed: Jun. 30, 2010

(65) Prior Publication Data

US 2012/0000882 A1 Jan. 5, 2012

(51) Int. Cl.
*B65D 90/02* (2006.01)

(52) U.S. Cl.
USPC ..... 215/382; 220/660; 220/669; 220/675; 215/379

(58) Field of Classification Search
USPC ..... 215/42, 382, 383; 220/669, 672, 673, 220/675
See application file for complete search history.

(56) References Cited

U.S. PATENT DOCUMENTS

| | | | | | |
|---|---|---|---|---|---|
| 4,755,404 | A | * | 7/1988 | Collette | 428/36.92 |
| 4,877,142 | A | * | 10/1989 | Doering | 215/382 |
| 4,949,861 | A | * | 8/1990 | Cochran | 215/42 |
| 5,066,528 | A | * | 11/1991 | Krishnakumar et al. | 428/36.92 |
| 5,217,128 | A | | 6/1993 | Stenger | |
| 5,281,387 | A | * | 1/1994 | Collette et al. | 264/521 |
| 5,407,086 | A | | 4/1995 | Ota et al. | |
| 5,520,877 | A | * | 5/1996 | Collette et al. | 264/521 |
| 5,614,148 | A | * | 3/1997 | Beck et al. | 264/532 |
| 5,735,420 | A | | 4/1998 | Nakamaki et al. | |
| 5,803,290 | A | * | 9/1998 | Bongiorno | 215/384 |
| 5,829,614 | A | * | 11/1998 | Collette et al. | 215/375 |
| 5,908,127 | A | | 6/1999 | Weick et al. | |
| 5,918,753 | A | * | 7/1999 | Ogg et al. | 215/382 |
| D414,700 | S | | 10/1999 | Zogg | |
| 6,095,360 | A | | 8/2000 | Shmagin et al. | |
| 6,161,713 | A | | 12/2000 | Krich | |
| 6,164,474 | A | | 12/2000 | Cheng et al. | |
| 6,247,606 | B1 | | 6/2001 | Zogg | |
| 6,296,131 | B2 | * | 10/2001 | Rashid | 215/383 |
| 6,349,838 | B1 | | 2/2002 | Saito et al. | |
| 6,372,318 | B1 | * | 4/2002 | Collette et al. | 428/35.7 |
| 6,398,052 | B1 | | 6/2002 | Cheng et al. | |

(Continued)

FOREIGN PATENT DOCUMENTS

| | | | | |
|---|---|---|---|---|
| EP | 0 751 071 | B1 | | 11/2001 |
| JP | 2011116456 | A | * | 6/2011 |
| WO | WO 2004/028910 | A1 | | 4/2004 |
| WO | WO 2005/123517 | A1 | | 12/2005 |

OTHER PUBLICATIONS

PCT/US2010/001112 International Search Report dated Oct. 5, 2011.

*Primary Examiner* — Anthony Stashick
*Assistant Examiner* — Chetan Chandra

(57) ABSTRACT

This disclosure is generally directed toward bottles with improved top loading resistance and does so by, among other things, utilizing walls, shoulder, and/or other structural features of a particular size, taper, angle, and/or material. The bottle includes a mouth, a barrel connected to a base, and a shoulder extending between the mouth and barrel. The shoulder may include upper, intermediate, and lower sections, in which the intermediate section may be relatively thicker than the upper section. The barrel may also include upper, intermediate, and lower sections, in which the intermediate section may be relatively thicker than the lower section.

17 Claims, 9 Drawing Sheets

(56) References Cited

U.S. PATENT DOCUMENTS

| | | | | |
|---|---|---|---|---|
| 6,431,401 | B1 | 8/2002 | Giblin et al. | |
| 6,464,106 | B1 | 10/2002 | Giblin et al. | |
| 6,585,123 | B1 | 7/2003 | Pedmo et al. | |
| 6,662,960 | B2 | 12/2003 | Hong et al. | |
| 6,695,162 | B1 | 2/2004 | Boukobza et al. | |
| 6,763,969 | B1 | 7/2004 | Melrose et al. | |
| 6,841,262 | B1 * | 1/2005 | Beck et al. | 428/542.8 |
| 6,923,334 | B2 | 8/2005 | Melrose et al. | |
| 6,964,347 | B2 | 11/2005 | Miura | |
| 7,051,890 | B2 * | 5/2006 | Onoda et al. | 215/383 |
| 7,108,146 | B2 | 9/2006 | Itokawa et al. | |
| 7,198,165 | B2 * | 4/2007 | Zhang | 215/381 |
| 7,228,981 | B2 | 6/2007 | Chisholm | |
| 7,445,826 | B2 * | 11/2008 | Collette et al. | 428/35.7 |
| 7,481,326 | B2 | 1/2009 | Itokawa et al. | |
| 7,798,349 | B2 * | 9/2010 | Maczek et al. | 215/381 |
| 8,091,720 | B2 * | 1/2012 | Colloud | 215/384 |
| 8,113,370 | B2 * | 2/2012 | Zhang et al. | |
| 2001/0037992 | A1 | 11/2001 | Tanabe et al. | |
| 2002/0084283 | A1 | 7/2002 | Giblin et al. | |
| 2002/0166837 | A1 * | 11/2002 | Gonzalez | 215/382 |
| 2006/0138074 | A1 | 6/2006 | Melrose | |
| 2006/0191860 | A1 | 8/2006 | Eisenbarth | |
| 2006/0255005 | A1 | 11/2006 | Melrose et al. | |
| 2007/0068894 | A1 | 3/2007 | Iwashita et al. | |
| 2007/0114200 | A1 | 5/2007 | Lane | |
| 2007/0199915 | A1 | 8/2007 | Denner et al. | |
| 2008/0011702 | A1 * | 1/2008 | Walsh | 215/44 |
| 2008/0047964 | A1 | 2/2008 | Denner et al. | |
| 2008/0149588 | A1 | 6/2008 | Nemoto et al. | |
| 2009/0065468 | A1 | 3/2009 | Hata et al. | |
| 2009/0266782 | A1 | 10/2009 | Lane | |
| 2009/0321384 | A1 * | 12/2009 | Zhang et al. | 215/383 |
| 2010/0012617 | A1 | 1/2010 | Ulibarri et al. | |
| 2010/0206837 | A1 * | 8/2010 | Deemer et al. | 215/381 |
| 2012/0024813 | A1 * | 2/2012 | Nakagawa et al. | 215/40 |
| 2012/0175338 | A1 * | 7/2012 | Castillo Higareda et al. | 215/382 |

* cited by examiner

BOTTLES WITH TOP LOADING RESISTANCE

BACKGROUND

1. Technical Field

This disclosure generally relates to bottles and more particularly related to bottles with improved top loading resistance.

2. Description of the Related Art

Liquid, flowable and/or squeezable consumer products have been marketed in plastic bottles, such as those made of polyolefins or polyesters. Exemplary bottle materials include polypropylene (PP) and polyethylene terephthalate (PET). While conventionally packaged in non-transparent containers with relatively thick sidewalls, larger quantities (e.g. 500-2000 mL) of heavier products, such as cleaning or detergent liquids, are now capable of being packaged in durable and recyclable plastic bottles with transparent and relatively thinner sidewalls.

Those bottles filled with liquid products often need to be vertically stacked on top of one another, such as during transportation, warehouse storage and/or at point-of-purchase display. The top loading resistance of the bottles required for stacking may depend upon the type of products and the specific stacking configurations. However, conventional plastic bottles generally have limited and insufficient top loading resistance, especially when the products are heavier liquids. As a result, bottles filled with liquid products in the bottom may be subjected to substantial top loading forces and may buckle or even collapse, causing economic loss in terms of inventory replacement and the labor needed for clean-up, or damage to the facility or vehicle in which the collapse occurs.

Accordingly, efforts have been directed to increasing the top loading resistance of plastic bottles. For example, additional structural features such as sidewall ribs, sidewall panels, and bottom ribs, have been found to improve the top loading resistance of plastic bottles. These structural features, however, are not without their cost. In particular, the panels and ribs often require more plastic material to be used, which is undesirable both economically and environmentally.

Bottles with variable wall thickness are also known in the art. For example, it has been found that gradual thickening of the sidewall (up to four times), both upwardly toward the shoulder and neck portions and downwardly toward the bottom base portion, improves bottle strength against laterally imposed stacking and crushing loads, such as in a vending machine. However, the effectiveness of such wall thickness profile against top loading forces remains to be established.

SUMMARY OF THE DISCLOSURE

Bottles with improved top loading resistance are disclosed herein. The bottles may have variable wall thickness and/or specific shoulder angles to improve top loading resistance. The bottle may also include other structural features such as surface grooves, ribs, and convex bottom walls.

In one exemplary embodiment, the bottle includes a mouth, a barrel connected to a base, and a shoulder extending between the mouth and barrel. The shoulder includes upper, intermediate, and lower sections. The intermediate section may be relatively thicker than the upper section of the shoulder.

In another exemplary embodiment, the bottle includes a mouth, a barrel connected to a base, and a shoulder extending between the mouth and barrel. The barrel includes upper, intermediate, and lower sections. The intermediate section may be relatively thicker than the upper section of the shoulder.

In yet another exemplary embodiment, the bottle includes a mouth, a barrel connected to a base, and a shoulder extending between the mouth and barrel. The shoulder includes an intermediate surface groove that is relatively thicker than the rest of the shoulder, while the barrel includes an intermediate ribbed portion that is relatively thicker than the rest of the barrel.

As used in this disclosure, "thickness" of a structural component of a bottle refers to wall thickness unless otherwise indicated. If wall thickness of the structural component is not uniform, "thickness" used in this disclosure refers to the average wall thickness of the structural component.

Other features of the disclosed bottle will be described in greater detail below. It will also be noted here and elsewhere that the bottle disclosed herein may be suitably modified to be used in a wide variety of applications by one of ordinary skill in the art without undue experimentation.

BRIEF DESCRIPTION OF THE DRAWINGS

For a more complete understanding of the disclosed bottle, reference should be made to the exemplary embodiments illustrated in greater detail in the accompanying drawings, wherein.

It should be understood that the drawings are not necessarily to scale and that the disclosed exemplary embodiments are sometimes illustrated diagrammatically and in partial views. In certain instances, details which are not necessary for an understanding of the disclosed bottle which render other details difficult to perceive may have been omitted. It should be understood, of course, that this disclosure is not limited to the particular exemplary embodiments illustrated herein.

DETAILED DESCRIPTION OF THE DISCLOSURE

As indicated above, this disclosure is generally directed toward bottles and more particularly related to improvement of top loading resistance of such bottles. As will be explained in further detail herein, it does so by, among other things, incorporating walls of particular dimensions and tapers, providing shoulder and other transition zones at particular angles, and/or utilizing other structural features. It is to be understood that some figures of this application illustrate bottles with different shades of grey merely for better visualization of their structural components, and should not be construed in any way as limiting the scope of this disclosure as the disclosed bottles may be transparent, translucent, opaque, or non-transparent and may be colored or colorless.

Figure 1:
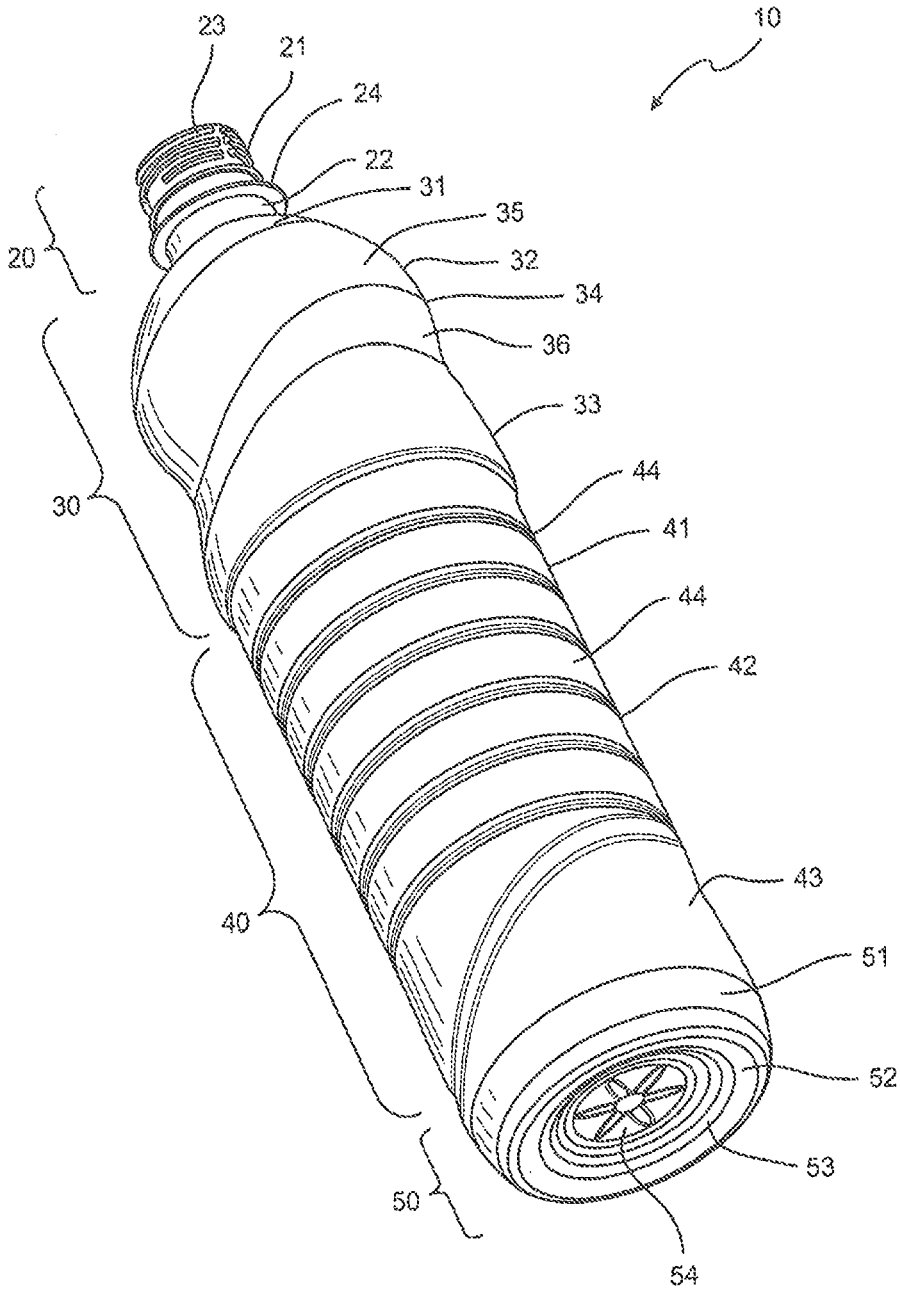
FIG. 1 is a perspective view of a bottle with sidewall thickening in both upward and downward directions.

Turning to FIG. 1, a bottle 10 with variable wall thickness is illustrated as including a mouth 20, a shoulder 30, a barrel 40, and a base 50. The mouth 20 is generally cylindrical and may include an upper section 21 terminating into a top opening and a lower section 22 connected to the shoulder 30. The upper section 21 may include surface threads 23 and an annular abutment 24 for complementary reception and fitment of a threaded cap (not shown).

Figure 2A:
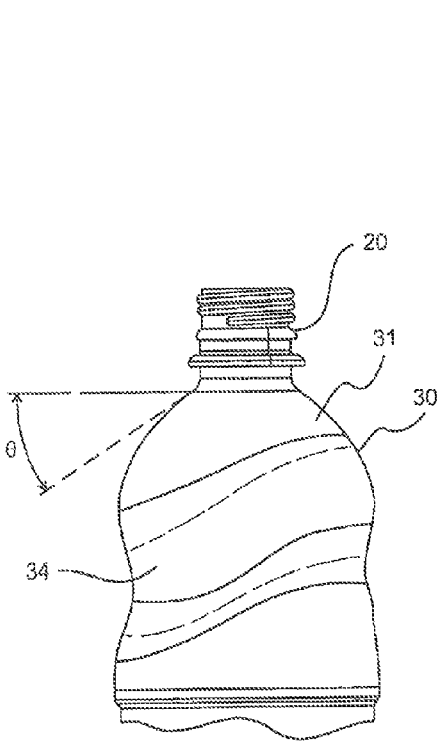
FIG. 2A is a side and partial top view of the bottle shown in FIG. 1, particularly illustrating the shoulder angle of the bottle.
Figure 2B:
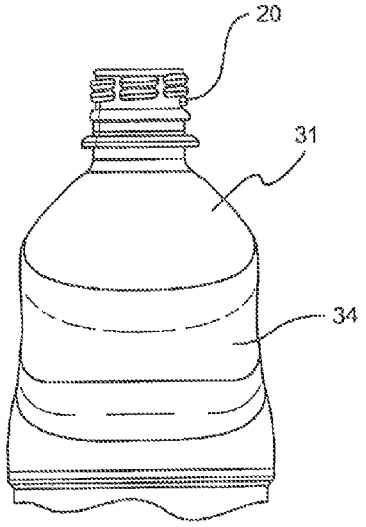
FIG. 2B is a front and partial top view of the bottle shown in FIG. 1, particularly illustrating the shoulder angle of the bottle.

The shoulder 30 includes an upper section 31 connected to the mouth 20, an intermediate section 32, and a lower section 33 connected to the barrel 40. The intermediate section 32 may include a diagonal surface groove 34. The surface groove 34 may have an upper portion 35 connected to a lower portion 36. As illustrated in FIG. 2, the bottle 10 has a symmetrical and relatively narrow shoulder angle θ, defined as the merging angle between the upper section 31 of the shoulder 30 and an imaginary horizontal plane that separates the mouth 20 and the shoulder 30. The shoulder angle of the bottle 10 shown in FIG. 2 is about 33.6°.

Turning back to FIG. 1, the barrel 40 includes an upper section 41 connected to the shoulder 30, an intermediate section 42, and a lower section 43 connected to the base 50. The upper and intermediate sections (41, 42) of the barrel 40 may each include one or more ribs 44. The ribs 44 may be horizontal and evenly spaced apart.

The base 50 includes a sidewall 51 connected to a bottom wall 52. The bottom wall 52 may be convex and include a peripheral region 53 and a central region 54. Without wishing to be bound by any particular theory, it is contemplated that the surface groove 34, ribs 44, and convex bottom wall 52 may each and/or collectively contribute to the top loading resistance of the bottle.

In order to further enhance the top loading resistance of the bottle 10, the thickness of the mouth 20, shoulder 30, barrel 40, and base 50, including their structural components, may be varied. The thickness profile of the bottle 10 is listed in Table 1 below, which indicates gradual upward thickening from the intermediate section 42 of the barrel 40 to the mouth 20 (from about 0.19 mm to about 1.11 mm), as well as gradual downward thickening from the intermediate section 42 of the barrel 40 to the central region 54 of the base 50 (from about 0.19 mm to about 0.90 mm).

TABLE 1

Thickness Profile of Bottle in FIG. 1

| Structural Component | Thickness (mm) |
|---|---|
| Mouth (upper section) | 1.11 |
| Mouth (lower section) | 1.00 |
| Shoulder (upper section) | 0.23 |
| Shoulder (intermediate section, upper portion) | 0.22 |
| Shoulder (intermediate section, lower portion) | 0.22 |
| Shoulder (lower section) | 0.20 |

TABLE 1-continued

Thickness Profile of Bottle in FIG. 1

| Structural Component | Thickness (mm) |
|---|---|
| Barrel (upper) | 0.20 |
| Barrel (intermediate) | 0.19 |
| Barrel (lower) | 0.19 |
| Base (sidewall) | 0.20 |
| Base (bottom, peripheral) | 0.35 |
| Base (bottom, central) | 0.90 |

In order to evaluate the top loading resistance of a bottle disclosed herein, the bottle was subjected to increasing vertical load (N) while the vertical deformation of the bottle (mm) was recorded until the bottle crushes. Typically, a relatively linear relationship exists between the vertical load and vertical deformation until the bottle starts to crush, at which point the vertical load remains constant or may even decrease as the vertical deformation increases. Thus, the vertical load just before crush ("crushing load") is one parameter that may be used to characterize the top loading resistance of the bottle, with a higher crushing load indicating better top loading resistance. Another parameter than may also be used to characterize the top loading resistance of the bottle is the deformation just before crush ("crushing deformation"), with a lower crushing deformation indicating better top loading resistance.

Figure 3:
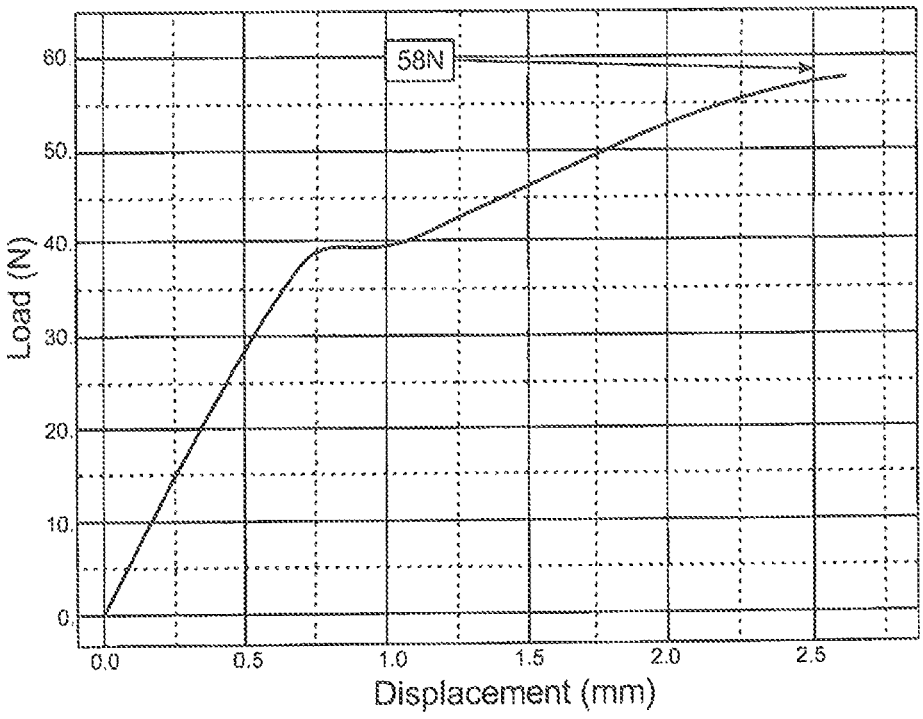
FIG. 3 is a graph illustrating the top loading resistance of the bottle shown in FIGS. 1-2.

As illustrated in FIG. 3, the bottle 10 has a final crushing load approaching 58 N and a final crushing deformation of more than about 2.6 mm. Moreover, the top loading response of the bottle 10 is not linear and appears to have two stages. At first, the vertical load increases relatively rapidly with the vertical deformation, indicating an effective top loading response. As the vertical load approaches 40 N, however, the bottle 10 sustains substantial vertical deformation (about 0.75 mm to about 1.00 mm) while the vertical load remains substantially unchanged at around 39 N. Thereafter, the vertical load increases relatively slowly with the vertical deformation until the bottle finally crushes at a crushing load of about 58 N and a crushing deformation of more than about 2.6 mm.

Without wishing to be bound by any particular theory, such a non-linear response to vertical load may suggest a structural change and/or rigidity redistribution of the bottle 10 at around 39 N vertical load and about 0.75 mm vertical deformation, resulting in a deformed but still not completely crushed bottle with a less effective top loading response. The inventors have determined that by changing the thickness profile, shoulder angle, and/or other structural component of the bottle, a more linear top loading response with higher crushing load and/or lower crushing deformation may be achieved, an insight heretofore unknown.

Figure 4:
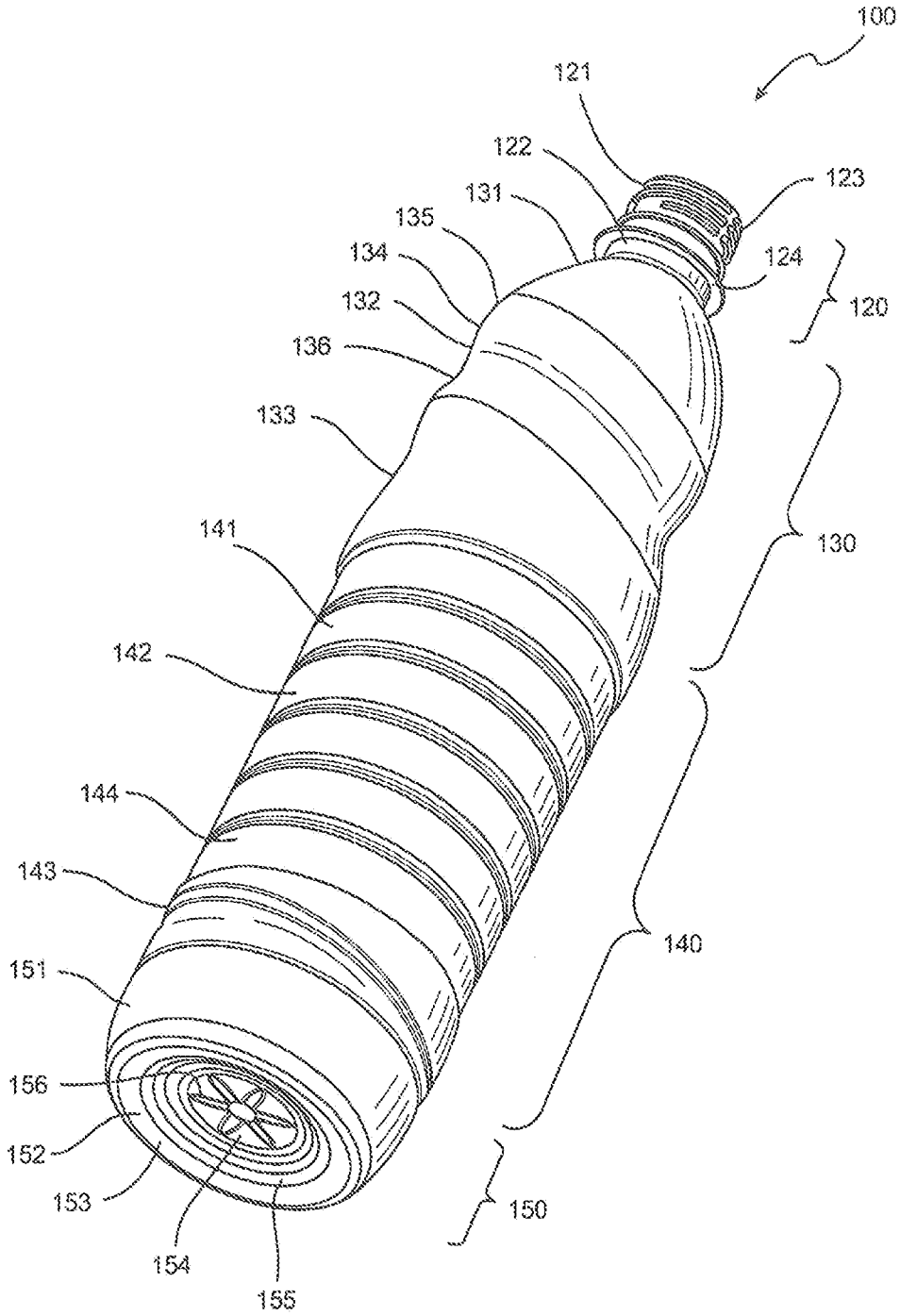
FIG. 4 is a perspective view of a bottle according to this disclosure.

To that end, FIG. 4 illustrates another bottle 100, but one with a wall thickness profile that improves top loading resistance according to one exemplary embodiment of this disclosure. The bottle 100 includes a mouth 120, a shoulder 130, a barrel 140, and a base 150. The mouth 120 is generally cylindrical and may include an upper section 121 terminating into a top opening and a lower section 122 connected to the shoulder 130. The upper section 121 may include surface threads 123 and an annular abutment 124 for complementary reception and fitment of a threaded cap (not shown).

Figures 5A, 5B:
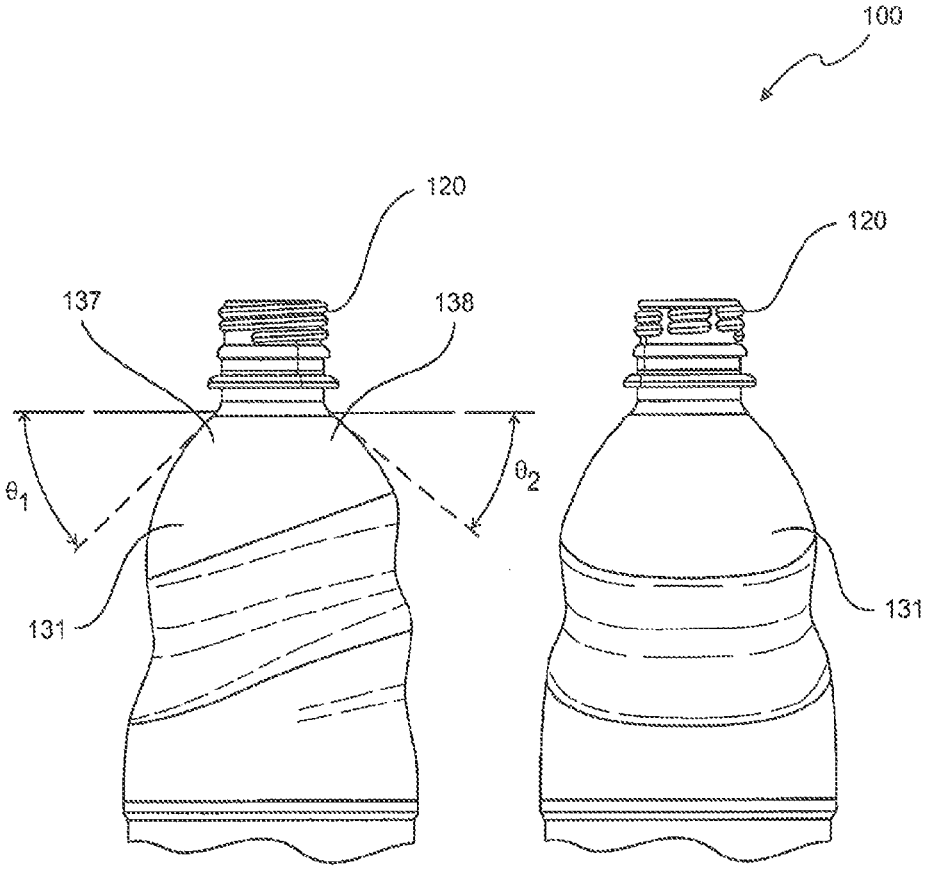
FIG. 5A is a side partial top view of the bottle shown in FIG. 4, particularly illustrating the shoulder angles of the bottle.
FIG. 5B is a front partial top view of the bottle shown in FIG. 4, particularly illustrating the shoulder angles of the bottle.

The shoulder 130 includes an upper section 131 connected to the mouth 120, an intermediate section 132, and a lower section 133 connected to the barrel 140. The intermediate section 132 may include a diagonal surface groove 134. The surface groove 134 may have an upper portion 135 connected to a lower portion 136. Unlike the bottle 10 illustrated in FIG. 2, the bottle 100 may have asymmetrical shoulder angles as illustrated in FIG. 5. Specifically, the top section 131 of the shoulder 130 includes a front portion 137 with a first shoulder angle $\theta_1$ and a back portion 138 with a second shoulder angle $\theta_2$. The shoulder angle $\theta_1$ may be greater than the shoulder angle $\theta_2$. Moreover, both shoulder angles ($\theta_1$, $\theta_2$) of the bottle 100 are relatively wider than the symmetrical shoulder angle $\theta$ of bottle 10 illustrated in FIG. 2. For example, the shoulder angle $\theta_1$ may be no less than about 44° and the shoulder angle $\theta_2$ may be no less than about 38°. For example, the shoulder angles ($\theta_1$, $\theta_2$) of the bottle 100 shown in FIG. 5 are about 44.2° and about 38.7°, respectively. Wider shoulder angles may also be used to further improve the top loading resistance of the bottle provided that they do not unnecessarily reduce the volume capacity of the bottle.

Turning back to FIG. 4, the barrel 140 includes an upper section 141 connected to the shoulder 130, an intermediate section 142, and a lower section 143 connected to the base 150. The upper and intermediate sections (141, 142) of the barrel 140 may each include one or more ribs 144. The ribs 144 may be horizontal and evenly spaced apart. The base 150 includes a sidewall 151 connected to a bottom wall 152. The bottom wall 152 may be convex and include a peripheral region 153 and a central region 154. The bottom wall 152 may also include one or more stepped structures 155 and/or radially extending ridges 156 to further improve the top loading resistance of the bottle 100.

In order to further enhance the top loading resistance of the bottle 100, the thickness of the mouth 120, shoulder 130, barrel 140, and base 150, including their structural components, may be further varied. The thickness profile of the bottle 100 is listed in Table 2 below. Similar to the bottle 10, the bottle 100 features gradual downward thickening from the intermediate section 142 of the barrel 140 to the central region 154 of the base 150 (from about 0.18 mm to about 1.00 mm). Unlike the bottle 10, however, no gradual upward thickening is featured in the bottle 100. Instead, the upper section 131 of the shoulder 130 is relatively thinner than the rest of the shoulder (combination of 132 and 133). In this exemplary embodiment, for example, the thickness of the intermediate and lower sections (132, 133) of the shoulder 130, i.e. (0.18+0.24)/2=0.21 mm, is at least 1.10 times the thickness of the upper section 131 of the shoulder 130.

TABLE 2

Thickness Profile of Bottle in FIG. 4

| Structural Component | Thickness (mm) |
|---|---|
| Mouth (upper section) | 1.11 |
| Mouth (lower section) | 1.00 |
| Shoulder (upper section) | 0.19 |
| Shoulder (intermediate section, upper portion) | 0.18 |
| Shoulder (intermediate section, lower portion) | 0.24 |
| Shoulder (lower section) | 0.25 |
| Barrel (upper) | 0.18 |
| Barrel (intermediate) | 0.18 |
| Barrel (lower) | 0.19 |
| Base (sidewall) | 0.20 |
| Base (bottom, peripheral) | 0.50 |
| Base (bottom, central) | 1.00 |

Figure 6:
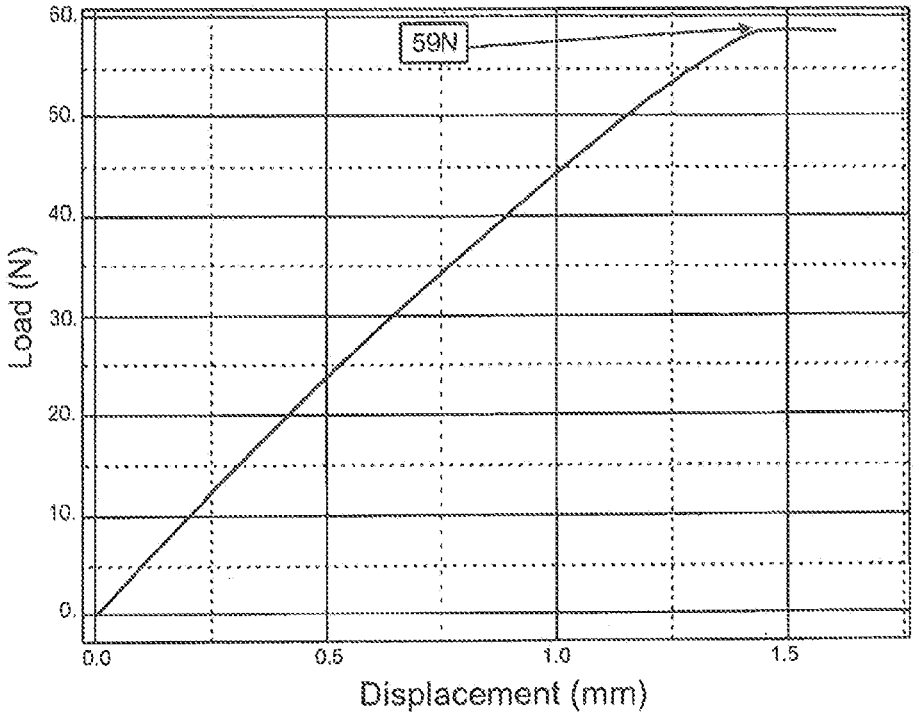
FIG. 6 is a graph illustrating the top loading resistance of the bottle illustrated in FIGS. 4-5.

The top loading resistance of the bottle 100 is illustrated in FIG. 6. The non-linear top loading response shown in FIG. 3 regarding the top loading response of bottle 10 is completely eliminated in the bottle 100. As illustrated in FIG. 6, the bottle 100 has a crushing load of about 59 N, which is slightly better than the about 58 N crushing load of the bottle 10. Further, the crushing deformation of the bottle 100 is about 1.4 mm, which is a significant improvement over the more than about 2.6 mm crushing deformation achieved by the bottle 10. Combining with the improved linear top loading response, it is contemplated that the revised shoulder angles and/or the thickness profile of the bottle 100 may contribute to the improvement in top loading resistance.

Turning now to FIGS. 7-11, a bottle 200 with further improved top loading resistance according to another exemplary embodiment of this disclosure is illustrated as including a mouth 220, a shoulder 230, a barrel 240, and a base 250. The mouth 220 is generally cylindrical and may include an upper section 221 terminating into a top opening and a lower section 222 connected to the shoulder 230. The upper section 221 may include surface threads 223 and an annular abutment 224 for complementary reception and fitment of a threaded cap (not shown).

Figure 9:
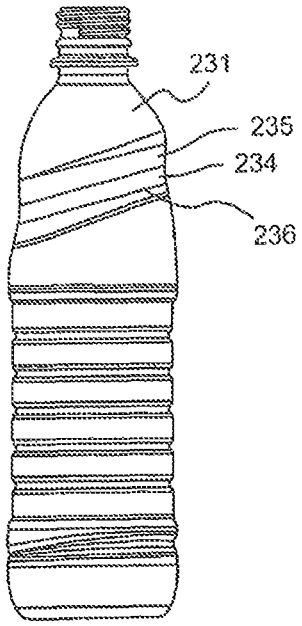
FIG. 9 is a side view of the bottle shown in FIG. 7.

The shoulder 230 includes an upper section 231 connected to the mouth 220, an intermediate section 232, and a lower section 233 connected to the barrel 240. The intermediate section 232 may include a diagonal surface groove 234. The surface groove 234 may have an upper portion 235 connected to a lower portion 236. Similar to the bottle 100 illustrated in FIG. 5, the bottle 200 may have asymmetrical shoulder angles as illustrated in FIG. 9. Accordingly, the top section 231 of the shoulder 230 includes a front portion 137 with a first shoulder angle $\theta_1$ and a back portion with a second shoulder angle $\theta_2$. The shoulder angle $\theta_1$ may be greater than the shoulder angle $\theta_2$.

Figure 10:
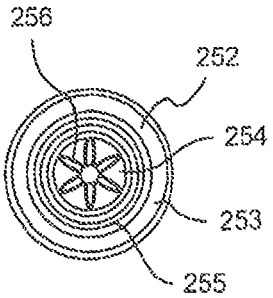
FIG. 10 is a bottom view of the bottle shown in FIG. 7
Figure 11:
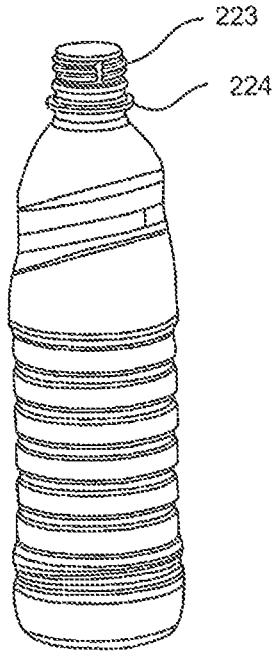
FIG. 11 is another perspective view of the bottle shown in FIG. 7.

The barrel 240 includes an upper section 241 connected to the shoulder 230, an intermediate section 242, and a lower section 243 connected to the base 250. The upper and intermediate sections (241, 242) of the barrel 240 may each include one or more ribs 244. The ribs 244 may be horizontal and evenly spaced apart. The base 250 includes a sidewall 251 connected to a bottom wall 252. The bottom wall 252 may be convex and include a peripheral region 253 and a central region 254. As illustrated in FIG. 10, the bottom wall 252 may also include one or more stepped structures 255 and/or radially extending ridges 256 to further improve the top loading resistance of the bottle 200.

The thickness profile of the bottle 200 is listed in Table 3 below. The upper section 231 of the shoulder 230 is relatively thinner than the rest of the shoulder (combination of 232 and 233). Moreover, the upper section 231 is relatively thinner than the intermediate section 232, which in turn is relatively thicker than the lower section 233. In particular, the thickness of the intermediate section 232 is about (0.33+0.26)/2=0.295 mm, which is at least 1.5 times the thickness of the upper section (about 0.19 mm) Unlike the bottle 100, however, the lower section 243 of the barrel 240 is relatively thinner than the rest of the barrel (combination of 241 and 242). Moreover, the lower section 243 is relatively thinner than the intermediate section 242, which in turn is relatively thicker than the upper section 241. As a result, the intermediate sections (232, 242) of both the shoulder 230 and the barrel 240 are strengthened in bottle 200.

TABLE 3

Figure 7:
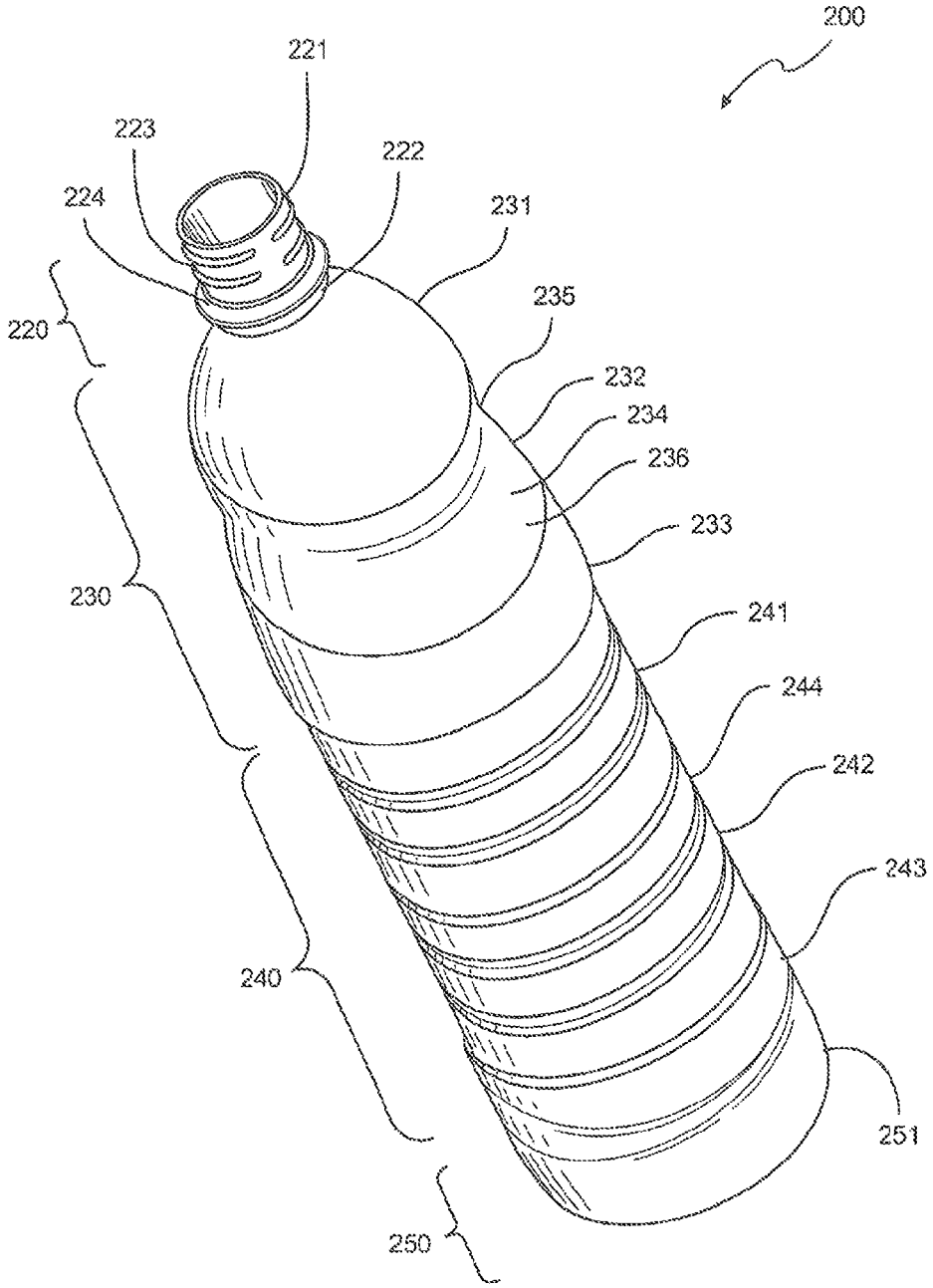
FIG. 7 is a perspective view of another bottle according to this disclosure.
Figure 8:
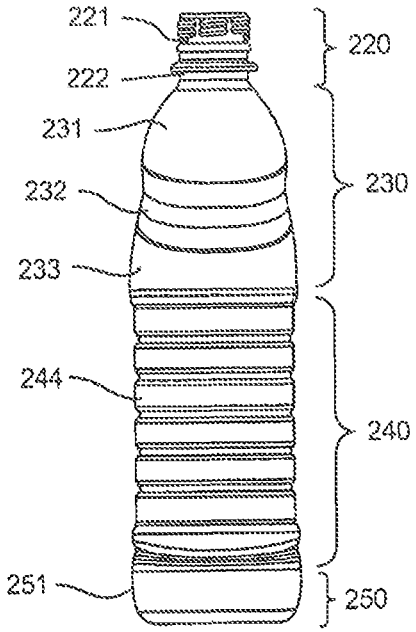
FIG. 8 is a front view of the bottle shown in FIG. 7.

Thickness Profile of Bottle in FIG. 7

| Structural Component | Thickness (mm) |
|---|---|
| Mouth (upper section) | 1.10 |

TABLE 3-continued

| Thickness Profile of Bottle in FIG. 7 | |
|---|---|
| Structural Component | Thickness (mm) |
| Mouth (lower section) | 1.00 |
| Shoulder (upper section) | 0.19 |
| Shoulder (intermediate section, upper portion) | 0.33 |
| Shoulder (intermediate section, lower portion) | 0.26 |
| Shoulder (lower section) | 0.21 |
| Barrel (upper) | 0.19 |
| Barrel (intermediate) | 0.22 |
| Barrel (lower) | 0.18 |
| Base (sidewall) | 0.18 |
| Base (bottom, peripheral) | 0.50 |
| Base (bottom, central) | 1.00 |

Figure 12:
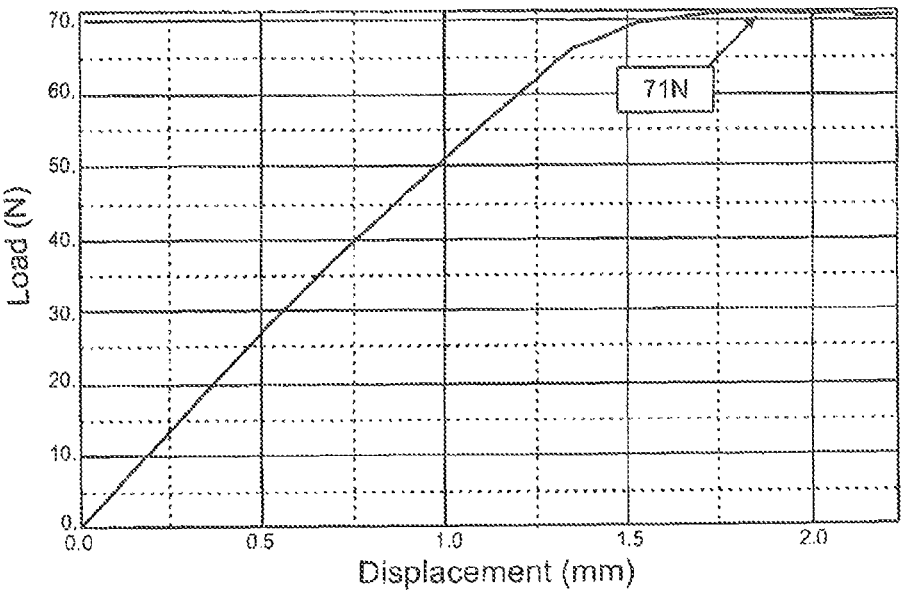
FIG. 12 is a graph illustrating the top loading resistance of the bottle illustrated in FIGS. 7-11.

The top loading resistance of the bottle 200 is illustrated in FIG. 12. The bottle 200 has a crushing load of about 71 N, which is a significant improvement over the bottle 10 (about 58 N) and the bottle 100 (about 59 N). Moreover, the bottle 200 has a crushing deformation of about 1.7 mm, which is comparable to the bottle 100 (about 1.4 mm) and significantly better than the bottle 10 (more than about 2.6 mm) Without wishing to be bound by any particular theory, it is contemplated that the revised thickness profile of the bottle 200 may contribute to the improvement in its top loading resistance.

The bottle disclosed herein may be made of thermoplastic materials such as polyolefins or polyesters. For example, the bottle may be made of polyethylene, polypropylene, polyethylene terephthalate, or the like. However, other polymeric materials, inorganic materials, metallic materials, or composites or laminates thereof may also be used. Further, the materials used in the disclosed bottles may be natural or synthetic. It is to be noted that the exemplary bottles described above all have an essentially identical weight (e.g. about 25.00 g). As a result, the improvement in top loading resistance, such as a higher crushing load and/or a lower crushing deformation, can be achieved without using more material or adding substantial weight to the bottle.

While only certain exemplary embodiments have been set forth, alternative embodiments and various modifications will be apparent from the above descriptions to those skilled in the art. These and other alternatives are considered equivalents and within the spirit and scope of this disclosure.

What is claimed is:

1. A bottle, comprising:

a mouth including a mouth upper section and a mouth lower section;

a base including a sidewall, a bottom and a peripheral region disposed between and connected the bottom and sidewall of the base;

a barrel including a barrel lower section connected to the sidewall of the base, the barrel also including a barrel upper section and a barrel intermediate ribbed section disposed between and connected to the barrel upper section and the barrel lower section, the barrel intermediate ribbed section having a wall thickness relatively thinner than a barrel lower section wall thickness; and a shoulder including a shoulder upper section connected to the mouth lower section, the shoulder also including a shoulder lower section connected to the barrel upper section and a shoulder intermediate section disposed between and connected to the shoulder upper section and the shoulder lower section, the shoulder intermediate section having a wall thickness relatively thicker than a shoulder upper section wall thickness and a shoulder lower section wall thickness.

2. The bottle of claim 1, wherein the shoulder intermediate section forms a surface groove that is diagonally oriented.

3. The bottle of claim 1, wherein the surface groove comprises an upper portion and a lower portion, the upper portion of the surface groove having a wall thickness that is thicker than a wall thickness of the lower portion of the surface groove.

4. The bottle of claim 1, wherein the shoulder upper section merges with the mouth lower section at a shoulder angle of no less than 38°.

5. The bottle of claim 1, wherein the shoulder upper section includes a front portion and a back portion, a shoulder angle between the front portion and the mouth lower section being greater than a shoulder angle between the back portion and the mouth lower section.

6. The bottle of claim 5, wherein the shoulder angle between the front portion and the mouth lower section is no less than 44°.

7. A bottle, comprising:

a mouth;

a barrel connected to a base; and a shoulder extending between the mouth and the barrel, the shoulder including a shoulder upper section, a shoulder intermediate section, and a shoulder lower section, the shoulder intermediate section having a wall thickness relatively thicker than a shoulder lower section wall thickness, and the barrel including a barrel upper section, a barrel intermediate section, and a barrel lower section, the barrel intermediate section having a wall thickness relatively thicker than a barrel lower section wall thickness.

8. The bottle of claim 7, wherein the barrel intermediate section wall thickness is relatively thicker than a barrel upper section wall thickness.

9. The bottle of claim 7, wherein the barrel upper and barrel intermediate sections each include at least one horizontal rib.

10. The bottle of claim 9, wherein the horizontal ribs on the barrel upper and barrel intermediate sections are evenly spaced apart.

11. The bottle of claim 7, wherein the base includes a sidewall connected to a convex bottom wall and wherein the convex bottom wall has a wall thickness at least twice as thick as the barrel intermediate section wall thickness.

12. The bottle of claim 11, wherein the wall thickness of the convex bottom wall is at least twice as thick as a wall thickness of the sidewall.

13. The bottle of claim 12, wherein the convex bottom wall includes a central region and a peripheral region a wall thickness of the central region being relatively thicker than a wall thickness of the peripheral region.

14. A bottle, comprising:

a mouth;

a barrel connected to a base; and a shoulder extending between the mouth and the barrel, the shoulder including an intermediate surface groove, the barrel including an intermediate ribbed portion, the intermediate surface groove having a wall thickness relatively thicker than a wall thickness of a remainder of the shoulder, and the intermediate ribbed portion having a wall thickness relatively thicker than a wall thickness of a remainder of the barrel.

15. The bottle of claim 14, wherein the shoulder merges with the mouth at a shoulder angle of no less than 38°.

16. The bottle of claim 15, wherein the shoulder includes a front portion and a back portion, wherein a shoulder angle between the front portion and the mouth is greater than a shoulder angle between the back portion and the mouth.

17. The bottle of claim 16, wherein the shoulder angle between the front portion and the mouth is no less than 44°.

* * * * *